United States Patent [19]

Yoshida

[11] Patent Number: 4,935,677

[45] Date of Patent: Jun. 19, 1990

[54] LOCK SYSTEM FOR AN AUTOMATIC DOOR

[75] Inventor: Yukio Yoshida, Toyama, Japan

[73] Assignee: Yoshida Kogyo K. K., Tokyo, Japan

[21] Appl. No.: 308,047

[22] Filed: Feb. 9, 1989

[51] Int. Cl.[5] ..... E05C 19/16

[52] U.S. Cl. ..... 318/266; 292/251.5; 70/95; 318/468

[58] Field of Search ..... 318/264, 265, 266, 286, 318/466, 467, 468, 599; 49/30, 35, 280, 340; 70/95, 271, 275, 277, 278; 292/251.5, DIG. 57

[56] References Cited

U.S. PATENT DOCUMENTS

| | | | |
|---|---|---|---|
| 4,564,791 | 1/1986 | Brickner | 318/266 X |
| 4,673,848 | 6/1987 | Hagiwara et al. | 318/266 |
| 4,703,962 | 11/1987 | Kelly et al. | 292/251.5 |
| 4,763,937 | 8/1988 | Sittnick, Jr. et al. | 292/251.5 |

FOREIGN PATENT DOCUMENTS

| | | |
|---|---|---|
| 60-68171 | 6/1985 | Japan . |
| 61-117598 | 7/1986 | Japan . |
| 62-54952 | 11/1987 | Japan . |

*Primary Examiner*—Bentsu Ro

*Attorney, Agent, or Firm*—Hill, Van Santen, Steadman & Simpson

[57] ABSTRACT

An automatic-door lock system in which an endless belt running round a driving pulley driven by an electric motor and a driven pulley spaced apart from the driving pulley, comprises: means for issuing a pulse signal proportionate to a speed of a door member; an automatic door controller which receives the pulse signal to determine the condition of the door member in its position, travel direction and speed on the basis of the pulse signal, and numerically controls the electric motor; a lock mechanism for locking the door member, the lock mechanism having an electromagnet element which is so energized as to attract the driven pulley to its stationary member to make it possible to lock up the door member; and an electromagnetic lock controller for permitting a current to flow through the electromagnet element at a time when the automatic door controller determines that the speed of the door member is reduced to zero in a closing area of the door member.

5 Claims, 2 Drawing Sheets

LOCK SYSTEM FOR AN AUTOMATIC DOOR

BACKGROUND OF THE INVENTION

1. Field of the Invention:

The present invention relates to a lock system for an automatic door system a door member of which is moved so as to be opened and closed by means of an electric motor, and more particularly to an automatic-door lock system which makes it possible to lock a door member thereof to its closed positon without employing any detection switch for detecting a closed position of the door member.

2. Description of the Prior Art:

For example, as is clear from an automatic-door lock system disclosed in Japanese Patent Publication No. 62-54952, lock systems for locking the door members of automatic door systems to their closed positions at ends of closing strokes of the door members have been well known in the prior art for many years.

The converntional automatic-door lock system disclosed in the above Japanese Patent Publication comprises: a detection switch for detecting a closed position of a door member of an automatic door system; and a brake mechanism for stopping rotation of a pulley by energizing an electromagnet element for attracting the pulley to its stationary member. In operation, in the conventional automatic-door lock system, the detection switch detects the closed position of the door member at the end of the closing stroke of the door member so that the electromagnet element is energized through the detection switch so as to attract the pulley to its stationary member, whereby rotation of the pulley is stopped by friction caused between the pulley and the stationary member. As a result, it is possible for the conventional automatic-door lock system to lock the door member to its closed position.

In such conventional automatic-door lock system, the detection switch must be precisely positioned so as to be actuated at the end of the closing stroke of the door member. However, it is very difficult to precisely position the detection switch.

SUMMARY OF THE INVENTION

In view of the above disadvantage inherent in the conventional automatic-door lock system, the present invention is made to resolve such disadvantage.

Therefore, it is an object of the present invention to provide an automatic-door lock system which makes it possible to lock a door member to its closed position without employing any detection switch for detecting a closed condition of the door member.

The above object of the present invention is accomplished by providing:

An automatic-door lock system in which an endless belt means running round a driving pulley driven by an electric motor and a driven pulley spaced apart from the driving pulley, comprising:

means for issuing a pulse signal proportionate to a travel speed of a door member;

an automatic door controller which receives the pulse signal to judge the condition of the door member in its position, travel direction and travel speed on the basis of the pulse signal, and numerically controls the electric motor;

a lock mechanism for use in locking the door member, the lock mechanism being provided with an electromagnet element which is so energized as to attract the driven pulley to its stationary member to make it possible to lock up the door member; and an electromagnetic lock controller for permitting an electric current to flow through the elcetromagnet element at a time when the automatic door controller judges that the travel speed of the door member is reduced to zero in a closing area of the door member.

In the automatic-door lock system of the present invention having the above construction, according to the present invention, a manual lock release switch for manually releasing a lock condition of the lock mechanism is included in a circuit connecting the electromagnetic lock controller with the mechanism.

Further, the automatic-door system of the present invention, according to the present invention, the automatic door controller comprises: a main control circuit provided with a door position judgeing circuit, a door travel speed zero signal output circuit and a locking-area signal output circuit; a door travel speed control circuit; a door travel speed discriminating circuit; and a door travel dircetion discriminating circuit.

Furthermore, in the automatic-door lock system of the present invention, according to the present invention, the electromagnetic lock controller is electrically connected with a human-body detector which issues a human-body detection signal to the elcetromagnetic lock controller when it detects a human body.

Still further, according to the present invention, in the automatic-door lock system of the present invention: the electromagnetic element is connected to a DC power source through timer contacts and normally-closed relay contacts; a timer for controlling the timer contacts is so connected to the DC power source as to be combined with the electromagnet element in parallel therewith through a first switch which is closed on the basis of the locked-area signal issued from the locking-area signal output circuit; and a relay for controlling the normally-closed relay contacts is so connected to the DC power source as to be combined with the electromagnet element in parallel therewith through a second switch which is closed on the basis of the human-body detection signal issued from the human-body detector.

Additional objects, advantages and features of the present invention will become apparent from the detailed description of the preferred embodiments of the present invention, which will be made with reference to the accompanying drawings.

DESCRIPTION OF THE PREFERRED EMBODIMENTS

Now, an embodiment of an automatic-door lock system of the present invention will be described hereinbelow in detail with reference to the accompanying drawings.

Figure 1:
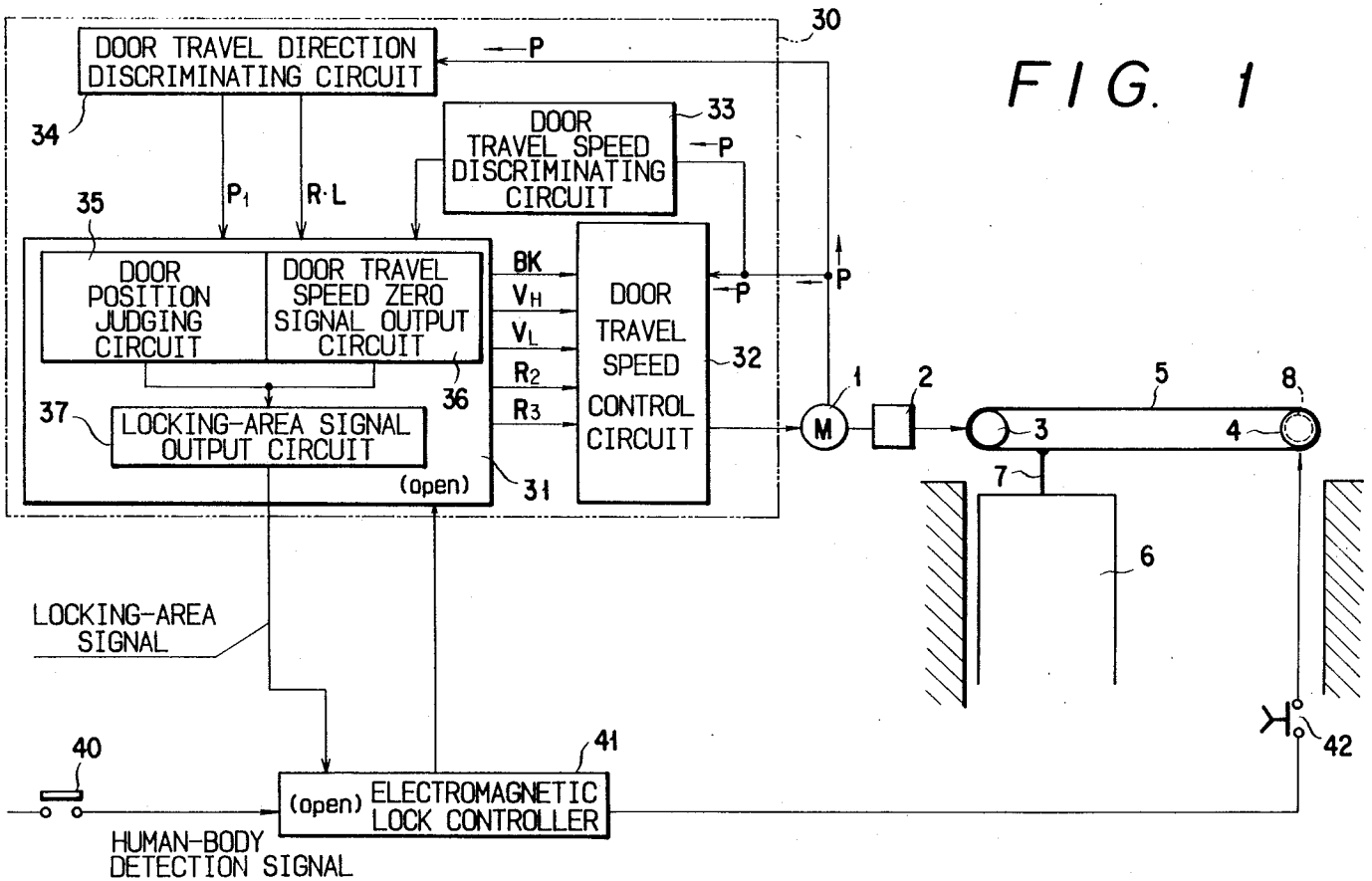
FIG. 1 is a block diagram view of an embodiment of the entire automatic-door lock system of the present invention.

As shown in FIG. 1, in an automatic-door lock system of the present invention, a driving pulley 3 is driven by an electric motor such as a DC brushless motor 1 through a speed-reduction unit 2 to drive a driven pulley 4 through an endless belt 5 running round them. A door member 6 is connected to the endless belt 5 through a suitable coupling device 7. The driven pulley 4 is adjacent to a stationary member of a lock mechanism 8 which is so actuated as to locks up the door member 5.

Figure 2:
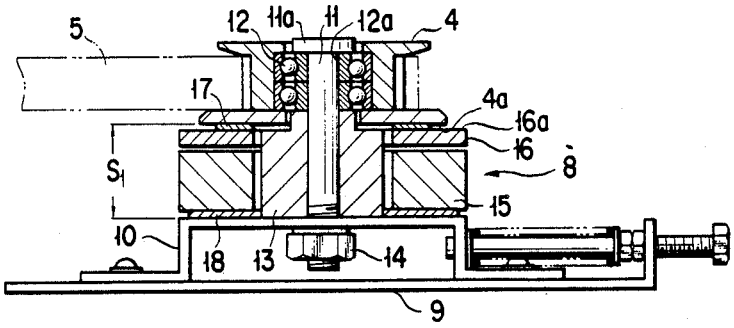
FIG. 2 is a cross-sectional view of the lock mechanism of the embodiment of the present invention shown in FIG. 1.

The lock mechanism 8 has a construction, for example such as one illustrated in FIG. 2.

In the construction of the lock mechanism 8 shown in FIG. 2, a pulley-mounting plate 10 assuming a substantially inverted U-shaped form is fixedly mounted on the stationary member or stationary plate 9 of the lock mechanism 8. On this pulley-mounting plate 10 is fixedly mounted a shaft 11 in an extended-end portion of which is mounted a bearing 12 through which the drven pulley 4 is rotatably supported by the extended-end portion of the shaft 11. On the other hand, the other end or base portion of the shaft 11 passes through a cylindrical collar 13 and is threaded to form a female screw threadably connected with a nut 14. When the nut 14 having been threadably connected with the shaft 11 is fastened, an extended-end flange portion 11*a* of the shaft 11 abuts on a side surface of an inner race 12*a* of the bearing 12. At the same time, the other side surface of the inner race 12*a* of the bearing 12 abuts on an extended-end surface of the collar 13 a base-end portion of which abuts on the pulley-mounting plate 10, so that the pulley-mounting plate 10 is space apart from an end surface 4*a* of the driven pulley 4 by a distance or space $S_1$ as shown in FIG. 2. In the space $S_1$ are sequentially arranged: a cylindrical electromagnet element 15; a perforated armature disc 16; and a ring-like plate spring 17. The lock mechanism 8 is assembled from these components 15, 16 and 17. The plate spring 17 is fixed to both of the end surface 4*a* of the driven pulley 4 and an end surface 16*a* of the armature disc 16 by means of a plurality of screws mounted therein, which screws are so spaced apart from each other in a circumferential direction of the plate spring 17 that the driven pulley 4 and the armature disc 16 are alternately connected with the screws. The armature disc 16 is urged to the driven pulley 4 under the influence of a resilient force exerted by the plate spring 17 so as to be separated from the electromagnet element 15. When the electromagnet element 15 is energized wiht an electric current, the electromagnet element 15 attracts the armature disc 16 to it against the resilient force exerted by the plate spring 17 so that the other end surface of the armature disc 16 is brought into frictional contact with an end surface of the electromagnet element 15 to stop the rotational movement of the driven pulley 4. Incidentally, the electromagnest elment 15 is fixedly mounted on the pulley-mounting plate 10 through a base plate 18.

Figure 3:
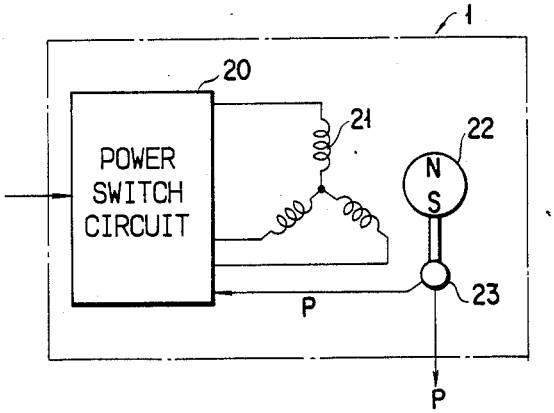
FIG. 3 is a circuit schematic of a DC brushless motor employed in the embodiment of the present invention shown in FIG. 1.

As shown in FIG. 3, the DC brushless motor 1 is provided with an armature winding 21 and a magnetic field system 22, the armature winding 21 being connected with a power switch circuit 20. Oppositely disposed from the magnetic field system 22 is a magnetic-pole position detector 23 which issues a pulse signal P proportionate to rotation of the magnetic field system 22 to an automatic door controller 30 shown in FIG. 1, so that a position and like data of the door member 6 are calculated on the basis of such pulse signal P.

As shown in FIG. 1, the automtic door contoller 30 is provided with a main control circuit 31, a door travel speed control circuit 32, a door travel speed discriminating circuit 33 and a door travel direction discriminating circuit 34. In the main control circuit 31 are included: a door position judging circuit 35; a door travel speed zero signal output circuit 36 for issuing a signal at a time when the travel speed of the door member 6 is reduced to zero; and a locking-area signal output circuit 37 for issuing a locking-area signal at a time when the door position judging circuit 35 judges that the door member 6 enters a closing area thereof and the door travel speed zero signal output circuit 36 issues the signal.

The pulse signal P issued from the DC brushless motor 1 is supplied to both of the door travel speed discriminating circuit 33 and the door travel direction discriminating circuit 34. A human-body detection signal is issued from a human-body detector 40 for detecting a human-body by means of, for example such as a magnetic card and like special-purpose means attached to the human body. Such human-body detection signal is supplied to the main control circuit 31 through an electromagnetic lock controller 41. At this time, when the locking-area signal is also supplied to such electromagnetic lock controller 41, the electromagnetic lock controller 41 permits the electric current to flow through the elcetromagnet element 15 of the lock mechanism 8 through a manual lock release switch 42 so that the electromagnet element is energized.

Figure 4:
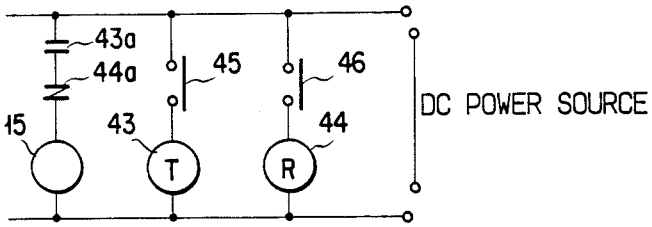
FIG. 4 is a circuit diagram of the electromagnetic lock controller associated with the electromagnet element employed in the embodiment of the present invention shown in FIG. 1.

In other words, as shown in FIG. 4, the electromagnet element 15 is connected to the DC power source through timer contacts 43*a* and normally-closed relay contacts 44*a*. The timer contacts 43*a* are controlled by a timer 43 which is so connected to the DC power source through a first switch 45 as to be combined with the electromagnet element 15 in parallel therewith. On the other hand, the normally-closed relay contacts 44*a* are controlled by a relay 44 which is so connected to the DC power source through a second switch 46 as to be combined with the electromagnet element 15 in parallel therewith. The first switch 45 is closed on the basis of the locking-area signal issued from the locking-area signal output circuit 37, while the second switch 46 is closed on the basis of the human-body detection signal issued from the human-body detector 40.

Now, operation of the automatic-door lock system of the present invention will be described hereinbelow in detail.

When the human-body detection signal is issued from the human-body detector 40 so as be supplied to the main control circuit 31 through the electromagnetic lock controller 41, the main control circuit 31 issues both of a high-speed signal $V_H$ and a open signal $R_2$ to the door travel speed control circuit 32 which in turn controls the DC brushless motor 1 so that the motor 1 is rotated at a high speed in the normal direction thereof, whereby the door member is moved so as to be opened.

At this time, the second switch 46 is closed on the basis of the human-body detection signal so that the relay 44 is energized to open the normally-closed contacts 44*a*. As a result, the electromagnet element 15 is de-energized to release the locking condition of the lock mechanism 8 so that the driven pulley 4 is allowed to rotate.

At the same time, the DC brushless motor 1 issues the pulse signal P to the door travel speed discriminating circuit 33 for calculating a travel speed of the door member 6. A signal representing the thus calculated travel speed of the door member 6 is issued from the door travel speed discriminating circuit 33 to the main control circuit 31. On the other hand, the pulse signal P issued from the DC brushless motor 1 is also supplied to the door travel direction discriminating circuit 34 to decide whether the door member 6 enter its opening area or whether it enters the closing area, so that the door travel direction discriminating circuit 34 issues an opening signal R or a closing signal L to the main control circuit 31, and also issues another pulse signal $P_1$ for count use to the main control circuit 31 to enable the door position judging circuit 35 of the main control circuit 31 to judge a position of the door member 6. The door position judging circuit 35 issues a signal to the locking-area signal output circuit 37 at a time when the door member 6 enters the closing area in its closing operation. In opening/closing operation, opening strokes and closing strokes of the door member 6 are measured to store the longest stroke thereof in a suitable memory of the door member 6 so that a deceleration position of the door member 6 and the closing area of the same are preset with respect to such longest stroke.

When the door member 6 reaches the thus preset deceleration position, the main control circuit 31 issues a braking signal BK to the door travel speed control circuit 32 to brake the DC brushless motor 1 so as to move the door member 6 at a low speed. On the other hand, when the door member 6 stops its high-speed travel, the main control circuit 31 issues a normal-rotation (opening operation) signal $R_2$ and a low-speed signal $V_L$ to the door travel speed control circuit 32 to cause the DC brushless motor 1 to rotate at a low speed in its normal direction so that the door member 6 is allowed to continue its low-speed opening motion which ceases at an end of the predetermined opening stroke of the door member 6.

After the lapse of a predetermined period of time after the door member 6 stops, the main control circuit 31 issues a reverse-rotation (closing operation) signal $R_3$ and a high-speed signal $V_H$ to the door travel speed control circuit 32 to cause the DC brushless motor 1 to rotate at a high speed in its reverse direction so that the door member 6 is allowed to start its high-speed closing operation.

When the door member 6 reaches the deceleration position thereof, the main control circuit 31 sequentially issues the braking signal BK, the low-speed signal $V_L$ and the reverse-rotation signal $R_3$ to the door travel speed control circuit 32 to brake the DC brushless motor 1 so as to stop the door member 6 at the end of the closing stroke thereof.

At this time, when the door member 6 enters its closing area corresponding to the longest stroke preset in the opening operation of the door member 6, the door position judging circuit 35 issues a signal to the locking-area signal output circuit 37. On the other hand, when the travel speed of the door member 6 is reduced to zero, the door travel speed zero signal output circuit 36 issues a zero signal to the locking-area signal output circuit 37. Consequently, upon receipt of these two signals, the locking-area signal output circuit 37 judges that the door member 6 reaches the end of the closing stroke thereof, and issues the locking-area signal to the electromagnetic lock controller 41 so that the first switch 45 is closed to actuate the timer 43 which controls the timer contacts **43*a*** so as to be closed after the lapse of a preset period of time.

At this time, since the human-body detection signal is not supplied to the electromagnetic lock controller 41 so that the second switch 46 remains off to de-energize the relay 44 so as to alllow the normally-closed relay contacts **44*a* to close, the electromagnet element 15 is energized whith the electric current to keep the lock mechanism 8 in its locking condition so that the driven pulley 4** stops its rotation.

Incidentally, at this time, the manual lock release switch 42 remains on.

As described above, when the door member 6 reaches the end of the closing stroke and stays there for a predetermined period of time, the lock mechanism 8 is locked. Under such circumstances, when the human-body detection signal is supplied to the electromagnetic lock controller 41, the locking condition of the lock mechanism 8 is released.

In addition, in the above-mentioned operation, each time the door member 6 stops at the end of the closing stroke thereof, the electromagnet element 15 is energized to lock the lock mechanism 8 the locking condition of which is released when the electromagnet element 15 is de-energized. Consequently, in the daytime in which it is not required to lock up the door member 6, the user may turns of the manual lock release switch 42 so as to de-energize the electromagnet element 15. On the other hand, at night through which it is required to lock up the door member 6, the user may turns on the manual lock release switch 42 so as to energize the electromagnet element 15.

In the embodiment of trhe automatic-door lock system of the present invention having the above construction, the electromagnet element 15 is energized to lock up the lock mechanism 8. However, it is also possible to lock up the lock mechanism 8 when the electromagnet element 15 is de-energized, if necessary.

In addition, in the above embodiment of the present invention, the longest stroke of the door member 6 and the position of the same 6 are calculated on the basis of the pulse signal issued from the DC brushless motor 1. However, according to the present invention, it is also possible to employ an AC motor in place of the DC brushless motor 1, the AC motor being connected with an encorder for issuing a pulse signal on the basis of which the position of the door member 6 is calculated. In addition, according to the present invention, it is also possible that the endless belt 5 is of a toothed typed the convex portions of which enable a detector to issue pulse signals corresponding to such concave -convex portions of the belt, the pulse signals being employed in calculation of the position of the door member 6.

In summary, according to the present invention , a suitable means for issuing the pulse signal proprotionate to the travel speed of the door member is provided in the automatic-door lock systerm of the present invention, and, on the basis of such pulse signal the position of the door member, the travel direction of the same and like data are calculated so as to numerically control the door member through the automatic door contoller of the auomatic-door lock system of the present invention

What is claimed is:

1. An automatic door lock system having an endles belt means running around a driving pulley driven by an electric motor and a driven pulley spaced apart from said driving pulley, comprising:

means for issuing a pulse signal proportionate to a travel speed of a door member;

and automatic door controller which receives said pulse signal to determine the condition of said door member in its position, travel direction and travel speed on the basis of said pulse signal, and numerically controls said electric motor;

a lock mechanism having a stationary member for use in locking said door member, said lock mechanism being provided with an electromagnetic element which is so energized as to attract said driven pulley to the stationary member to lock up said door member; and an electromagnetic lock controller for permitting and electric current to flow through said electromagnetic element at a time when said automatic door controller determines that the travel speed of said door member is reduced to zero in a closing area of said door member.

2. The automatic door lock system as set forth in claim 1, further comprises:

a circuit connected between said electromagnetic lock controller and said lock mechanism, said circuit having a manual lock release switch for manually releasing a lock condition of said lock mechanism.

3. The automatic door lock system as set forth in claim 1, wherein said automatic door controller includes:

a main control circuit having a door position judging circuit, a door travel speed zero signal output circuit and a locking-area signal output circuit;

a door travel speed control circuit;

a door travel speed discriminating circuit; and a door travel direction discriminating circuit.

4. The automatic lock system as set forth in claim 1, further comprises:

a human body detector electrically connected to said electromagnetic lock controller for issuing a human-body detection signal to said electromagnetic lock controller when said human body detector detects a human body.

5. The automatic door lock system as set forth in claim 1, further comprising:

a human body detector for issuing a human body dtection signal when it detects a human body;

a locking area signal output circuit for issuing a locking area signal;

said electromagnetic element being connected to a DC power source through timer contacts and normally-closed relay contacts;

a timer for controlling said timer contact, said timer being connected to said DC power source through a first switch, said first switch being closed when the locking-area signal is issued from said locking-area signal output circuit; and a relay for controlling said normally-closed relay contacts, said relay being connected to said DC power source though a second switch, said second switch being closed when the human-body detection signal is issued from said human-body detector.

* * * * *

UNITED STATES PATENT AND TRADEMARK OFFICE

CERTIFICATE OF CORRECTION

PATENT NO. : 4,935,677

DATED : June 19, 1990

INVENTOR(S) : Yukio Yoshida

It is certified that error appears in the above-indentified patent and that said Letters Patent is hereby corrected as shown below:

On the title page: Item [30] add the following:

Foreign Application Priority Data
February 12, 1988 [JP] Japan ... 63-28819

Signed and Sealed this

Twenty-seventh Day of May, 1997

*Attest:*

*Attesting Officer*

BRUCE LEHMAN

*Commissioner of Patents and Trademarks*